US010588366B2

(12) United States Patent
Cienski et al.

(10) Patent No.: US 10,588,366 B2
(45) Date of Patent: Mar. 17, 2020

(54) VENTILATION FOR ARTICLE OF APPAREL

(71) Applicant: Under Armour, Inc., Baltimore, MD (US)

(72) Inventors: Nick Cienski, Baltimore, MD (US); Alan Guyan, Baltimore, MD (US); Matthew Re, Baltimore, MD (US)

(73) Assignee: UNDER ARMOUR, INC., Baltimore, MD (US)

( * ) Notice: Subject to any disclaimer, the term of this patent is extended or adjusted under 35 U.S.C. 154(b) by 23 days.

(21) Appl. No.: 15/940,096

(22) Filed: Mar. 29, 2018

(65) Prior Publication Data

US 2018/0279704 A1 Oct. 4, 2018

Related U.S. Application Data

(60) Provisional application No. 62/479,377, filed on Mar. 31, 2017.

(51) Int. Cl.

| | |
|---|---|
| ***A41D 27/28*** | (2006.01) |
| ***A41B 1/10*** | (2006.01) |
| ***A41D 1/08*** | (2018.01) |
| ***A41D 3/00*** | (2006.01) |

(52) U.S. Cl.

CPC ..... *A41D 27/285* (2013.01); *A41B 1/10* (2013.01); *A41D 1/08* (2013.01); *A41D 3/00* (2013.01); *A41D 2300/20* (2013.01); *A41D 2300/322* (2013.01); *A41D 2600/10* (2013.01)

(58) Field of Classification Search

CPC ..... A41D 27/28; A41D 27/00

See application file for complete search history.

(56) References Cited

U.S. PATENT DOCUMENTS

| | | | | |
|---|---|---|---|---|
| 1,982,845 | A | 12/1934 | Wagman | |
| 2,123,447 | A | 7/1938 | Waite | |
| 3,153,793 | A * | 10/1964 | Lepore | A41D 3/00 2/108 |
| 4,608,715 | A * | 9/1986 | Miller | A41D 27/285 2/1 |
| 6,339,845 | B1 | 1/2002 | Burns et al. | |
| 6,766,565 | B2 | 7/2004 | Crye et al. | |
| 6,848,119 | B2 | 2/2005 | Crye et al. | |
| 7,197,772 | B2 | 4/2007 | Crye et al. | |
| 8,336,116 | B2 | 12/2012 | Seguin et al. | |

(Continued)

FOREIGN PATENT DOCUMENTS

| | | | |
|---|---|---|---|
| DE | 10261359 | A1 | 7/2004 |
| EP | 0412450 | A1 | 2/1991 |

*Primary Examiner* — Tajash D Patel

(74) *Attorney, Agent, or Firm* — Edell, Shapiro & Finnan, LLC

(57) ABSTRACT

A vent structure and a method of forming a vent from a vent structure are described herein. The vent structure includes a first elongate member, a second elongate member, and a set of ribs extending between the first elongate member and the second elongate member. The first elongate member is configured to be attached to a first side of an opening formed in an article of apparel and the second elongate member is configured to be attached to a second side of the opening, the second side being opposite the first side. Collectively, the first elongate member, second elongate member, and the set of ribs bias the first side and the second side to an open configuration that exposes and expands the opening.

23 Claims, 9 Drawing Sheets

(56) References Cited

U.S. PATENT DOCUMENTS

| | | | |
|---|---|---|---|
| 8,756,714 | B2 | 6/2014 | Reimer |
| 9,125,444 | B2 | 9/2015 | Mahaney |
| 2004/0133962 | A1 | 7/2004 | Baumel |
| 2005/0172381 | A1 | 8/2005 | Bush et al. |
| 2015/0327608 | A1 | 11/2015 | Kurtzweg |
| 2016/0135529 | A1 | 5/2016 | Traulle et al. |

* cited by examiner

VENTILATION FOR ARTICLE OF APPAREL

FIELD OF THE INVENTION

The present invention is directed toward ventilation for an article of apparel.

BACKGROUND

Articles of apparel, such as shirts, jackets, pants, etc., may be formed from textiles of various materials. When articles of apparel are intended for physical activity, such as sports, exercise, or other such activities or uses during which a user may generate heat, the articles of apparel may include accessories or features that assist the wearer in cooling down. That is, articles of apparel may include ventilation. For example, some ski jackets include vents. Typically, a vent only provides cooling when it is open and the amount of cooling provided by the vent is directly proportional to the size of the opening provided by the vent. Often large vent structures are needed to provide a large vent opening; however, large vent structures increase production costs and may introduce friction (chafing) points to the article of apparel, which decreases wearing comfort. Moreover, adding vents to an article of apparel (or including vents in the article of apparel), especially large vents, may significantly increase the overall weight of the article of apparel. This may be especially noticeable if an article of apparel is manufactured from lightweight fabric (e.g., running or golf apparel). Consequently, it would be desirable to provide a vent for an article of apparel that minimizes the size of the vent structure while also maximizing the size of the opening provided by the vent structure, thereby maximizing the heat dump provided by the vent while minimizing the weight and cost of the vent structure.

BRIEF SUMMARY

In accordance with example embodiments of the present invention, a vent structure and a method of forming a vent from a vent structure are described herein. The vent structure includes a first elongate member, a second elongate member, and a set of ribs extending between the first elongate member and the second elongate member. The first elongate member is configured to be attached to a first side of an opening formed in an article of apparel and the second elongate member is configured to be attached to a second side of the opening, the second side being opposite the first side. Collectively, the first elongate member, second elongate member, and the set of ribs bias the first side and the second side to an open configuration that exposes and expands the opening.

BRIEF DESCRIPTION OF THE DRAWINGS

Like numbers have been utilized to identify like components throughout the figures.

DETAILED DESCRIPTION

Figure 1:
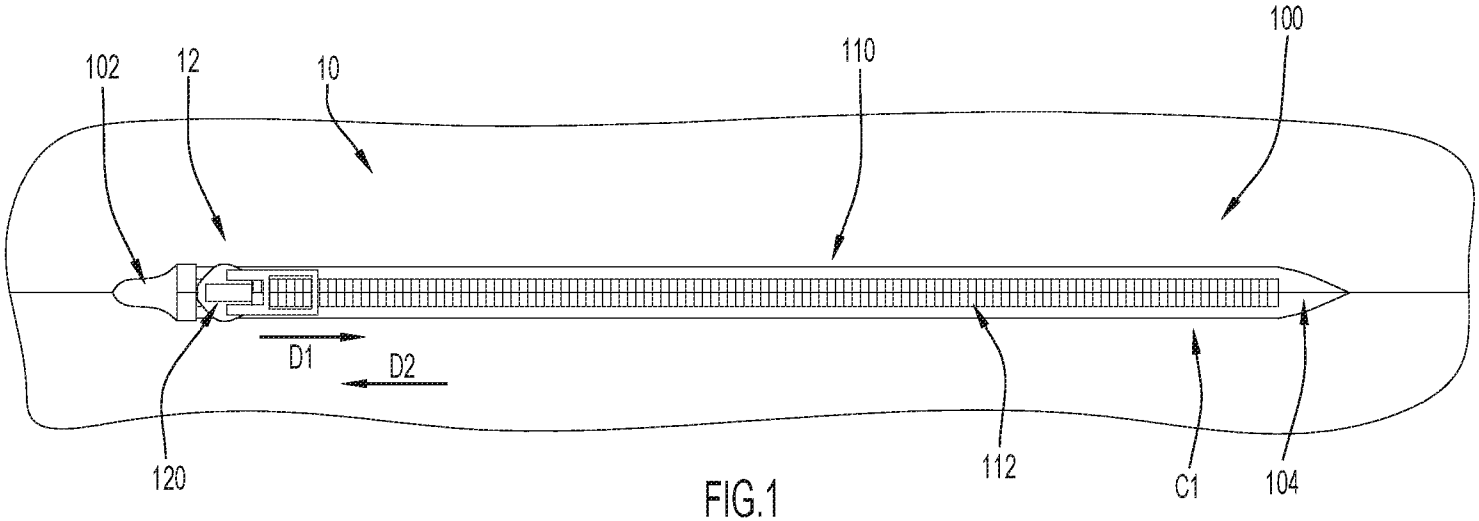
FIGS. 1 and 2 depict exterior views of a portion of an article of apparel including a vent formed with a vent structure according to a first example embodiment of the present invention, the vent being closed in FIG. 1 and open in FIG. 2.

In the following detailed description, reference is made to the accompanying figures which form a part hereof, wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

Now referring generally to the Figures, a vent, vent structure, and method of forming a vent with a vent structure are presented herein. The vent structure is generally configured to provide or create a vent that creates a physical opening in a garment. More specifically, the vent structure is configured to create a vent with opposing edges that are biased to move laterally away from each other. That is, the edges of an article of apparel (also referred to herein as a garment) on either side of an opening may be biased to move away from each other within the natural or resting plane of the article of apparel (i.e., the garment does not move towards or away from the wearer when the edges move apart). The biased vent structure creates an opening that is wider that conventional vents (i.e., simple zipper openings) and ensures that the vent remains open during movement of the garment (i.e., the vent remains open as the wearer moves). Consequently, the vent allows air to flow in and out of the garment (or at least in and out of a layer of fabric included in the garment). This allows heat generated by the wearer to be dumped or removed from the wearer quickly and efficiently (i.e., the heat escapes or dissipates through the vent, away from the wearer) which, in turn, allows a wearer to quickly cool down. Moreover, since the vent provides an opening that is wider that conventional vents, the vent presented herein may be approximately half the size (half the length) of conventional vents while providing at least the same amount of cooling and/or ventilation.

Figure 2:
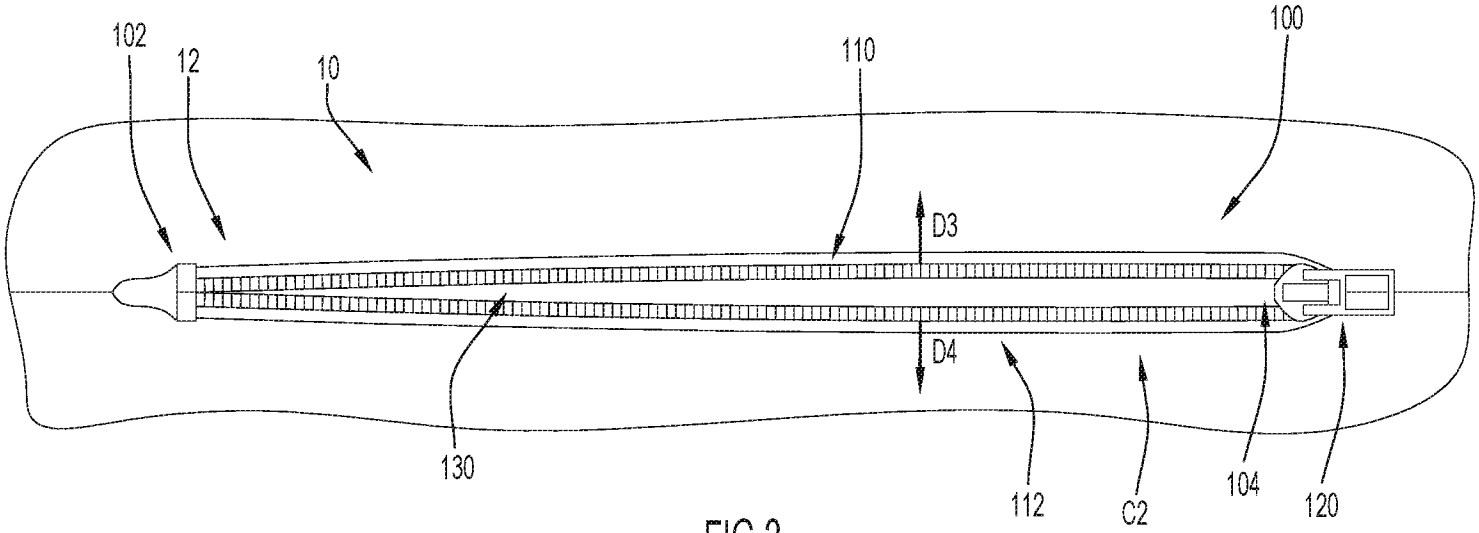

Now referring to FIGS. 1 and 2 for a description of a vent 100 formed in accordance with the techniques presented herein. The vent 100 extends from a first end 102 to a second end 104 (the distance between the first end 102 and the second end 104 may be referred to herein as the length or longitudinal span of the vent 100) and is configured to selectively create or provide an opening 130 in a layer or layers of fabric of the article of apparel 10. The opening 130 is defined by the first end 102, the second end 104, a first side 110, and a second side 112, and is provided when the first side 112 and the second side 114 are decoupled or detached and laterally separated from each other.

In the depicted embodiment, the vent 100 includes a zipper 120 that is configured to selectively couple interlocking teeth included on the first side or edge 110 to interlocking teeth included on the second side or edge 112. In particular, as the zipper 120 moves in direction D1 (i.e., from end 102 to end 104), the zipper 120 decouples the interlocking teeth from each other, which decouples the first side 110 from the second side 112. By comparison, as the zipper 120 moves in direction D2 (i.e., from end 104 to end 102), the zipper 120 couples (or recouples) the interlocking teeth included on the first side 110 to the interlocking teeth included on the second side 112 to couple or attach the first side 110 to the second side 112, or vice versa. That is, the zipper 120 can be used to move the vent 100 between a closed configuration C1 (in which the first side 110 and second side are brought together to substantially close or hide the opening 130, as seen in FIG. 1) and an open configuration C2 (in which the first side 110 and second side are separated and define or expose opening 130, as can be seen in FIG. 2). However, in other embodiments, any desirable fastener(s) or closure/sealing element may be utilized to selectively open the vent 100 (i.e., to selectively move the vent 100 between the closed configuration C1 and the open configuration C2).

As is described in detail below, as the first side 110 is decoupled from the second side 112, a vent structure 200 (see, for example, FIGS. 3 and 4) causes the first side 110 and second side 112 to move laterally away from each other, in directions D3 and D4, respectively, to create or define the opening 130 while also expanding the opening 130 as compared to a conventional vent (i.e., a simple zipper opening). In the particular embodiment depicted in FIGS. 1 and 2, as well as a majority of the embodiments shown in the Figures, the opening 130 extends through the article of apparel 10, from an exterior surface 12 to an interior surface 14. However, in other embodiments, the opening 130 need not extend entirely through the article of apparel 10 and may, instead, extend through one or more layers or portions of an article of apparel. As one example, the opening 130 may only extend through the outermost layer of fabric included in a ski coat or a pair of ski pants. As another example, mesh may extend behind at least a portion of the vent (as is shown at 260 in FIG. 9 and described below). Regardless, when the vent 100 is in open configuration C2 (i.e., sides 110 and 112 are spaced apart), the vent 100 will allow air to move in and out of the layer of fabric and/or the article of apparel 10. In the depicted embodiment, this ventilates the interior side 14 (see FIGS. 3 and 4) of the article of apparel 10 on which the vent 100 is installed by allowing air to move in and out of the article of apparel 10 (i.e., to cool a wearer).

Figure 3:
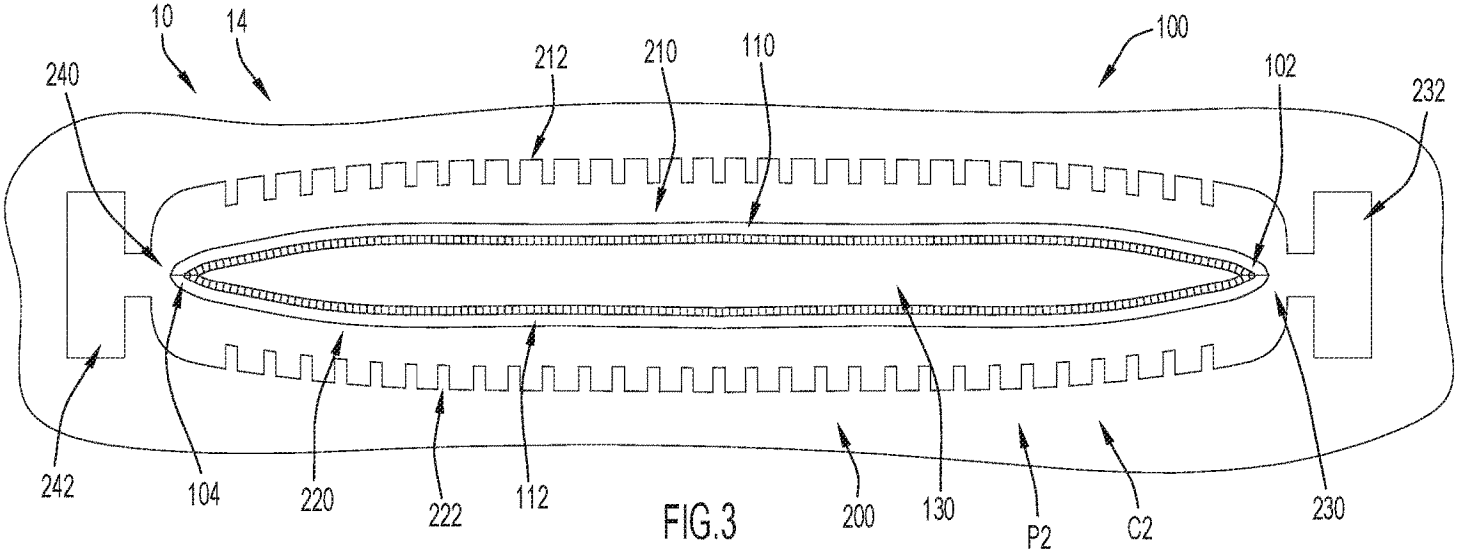
FIGS. 3 and 4 depict interior views of the vent formed with the vent structure of FIG. 1 and FIG. 2, with the vent being open in FIG. 3 and closed in FIG. 4.
Figure 4:
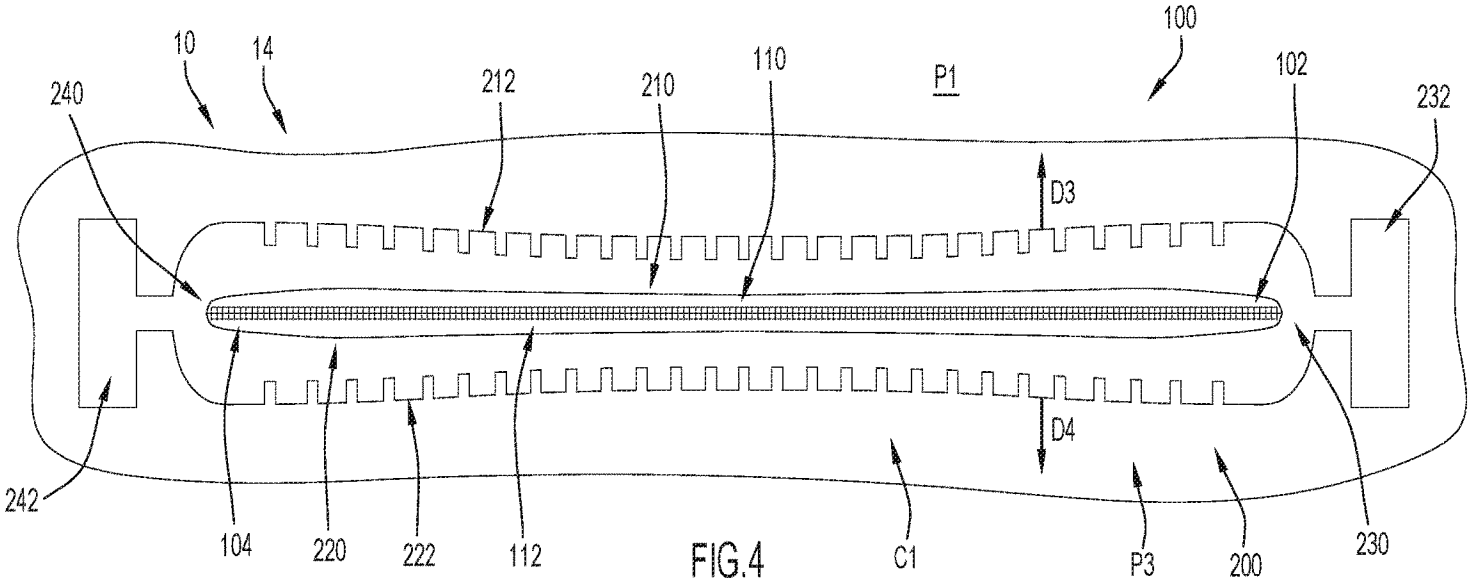

Now referring to FIGS. 3 and 4, as mentioned, a vent structure 200 included in or installed onto the vent 100 is configured to move the first edge 110 and second edge 112 laterally away from each other, in directions D3 and D4, respectively. However, the vent structure 200 is configured to move the first edge 110 and the second edge 112 within a plane of the article of apparel 10, which is generally represented as plane P1 in FIG. 4. In other words, in at least some embodiments, the vent structure 200 does not move edge 110 or edge 112 towards or away from a wearer; instead, the vent structure moves edge 110 and/or edge 112 substantially parallel to a portion of a wearer's body on which the vent is resting/adjacent and within the plane of the article of apparel (examples of which are described below in connection with FIGS. 14-16). This may minimize the amount of drag created by the vent structure, which may be important, for example, if the vent 100 is included on an article of apparel intended for running or activities that require quickness and/or minimal drag.

Generally, the vent structure 200 is or includes one or more resilient members that are biased to a rest or natural position P2. The rest position P2 corresponds to the open configuration C2 of the vent. That is, when the vent structure 200 is in its rest position P2, the vent 100 is in its open configuration C2. Consequently, the vent structure 200 is configured to provide the opening 130 unless sides 110 and 112 are secured together. This natural resiliency may be achieved or provided by manufacturing the vent structure from suitable plastics, such as with three dimensional printing or injection molding techniques, by embedding suitable plastic structures within the vent structure 200, by including resilient components within the vent structure 200, and/or by any other suitable manufacturing method. Suitable plastics may include any desirable plastic with a durometer value that allows the plastic to remain biased to the rest position P2 when the plastic is secured to a fabric of the article of apparel on which the vent structure is included or installed.

In the embodiment depicted in FIGS. 3 and 4, the vent structure 200 is injection molded and includes a first elongate member 210 and a second elongate member 220. The first elongate member 210 is coupled to the first side 110 and the second elongate member 220 is coupled to the second side 112. Each of these couplings may be provided with sewing, gluing, fasteners, or any other manner of adhering or coupling a plastic or plastic-like structure to a fabric that is now known or hereafter developed. Elongate members 210 and 220 are coupled together at the first end 102 and the second end 104 via end connectors 230 and 240, respectively. In their natural or rest position P2, the elongate members 210 and 220 and end connectors 230 and 240 collectively define an ovular assembly that causes the sides 110 and 112 to form an opening 130 that is extended or widened as compared to an opening provided by a conventional zipper (i.e., a zipper without a vent structure 200). The ovular shape of this assembly and the natural resiliency of the components of the assembly (i.e., the elongate members 210 and 220 and end connectors 230 and 240) biases the vent structure to provide the opening 130 and, thus, biases sides 110 and 112 to laterally separate from each other (i.e., in directions D3 and D4) when the sides 110 and 112 are not coupled or closed together in a manner that can overcome the force created by the biasing (i.e., by zipper 120). However, the biasing only creates enough force to separate side 110 from side 112, and does not create enough force to overcome a coupling provided by a suitable fastener or closure element, such as zipper 120 or hook and loop arrangements of appropriate strength.

As a more specific explanation, each of the elongate members 210 and 220 may have a length that is longer, at least slightly that the distance between end 102 and end 104 (i.e., the length of the vent). Consequently, in order to couple elongate members 210 and 220 (or more specifically end connectors 230 and 240) to or proximate to ends 102 and 104, the elongate members 210 and 220 include some arc or bend. The overall length (i.e., the arc length) of the elongate members 210 and 220 and the distance between end 102 and end 104 may define the radius (or radii) of curvature of each elongate member 210 and 220 and the radius (or radii) of curvature may, in turn, define the size of the opening 130 created by the vent 100. However, in use, the actual size of the opening 130 may be proportional to the size of the opening 130 provided by the vent structure 200 before the vent structure 200 is installed on the article of apparel 10 because the fabric of the article of apparel 10 may resist or counteract at least a portion of the natural resiliency or bias of the vent structure 200. In other words, in at least some instances, the fabric of the article of apparel may naturally pull the sides 110 and 112 together, at least some amount, regardless of the magnitude of the force created by the resiliency and shape of elongate member 210 and 220.

Still referring to FIGS. 3 and 4, since the vent structure 200 is constantly exerting lateral forces on the article of apparel 10 (i.e., lateral forces away from the opening 130 within the plane of the article of apparel 10, in directions D3 and D4), the portions of the article apparel 10 immediately adjacent the vent 100 (i.e., the portions immediately adjacent to sides 110 and 112) may have a natural tendency to pucker (i.e., protrude inwards and/or outwards with respect to the wearer), such as when the vent structure 200 moves to and/or is held in a compressed or non-natural position P3 (i.e., when the vent 100 is closed). To counteract this, the vent structure 200 may include various features that allow the fabric of the garment 10 to move without puckering. In the particular embodiment illustrated in FIGS. 3 and 4, elongate member 210 and elongate member 220 include notched outer edge 212 and notched outer edge 222, respectively. Notched outer edges 212 and 222 may flex longitudinally (i.e., substantially towards end 102 or end 104) and, thus, may allow the fabric of the article of apparel 10 to move with the elongate members 210 and 220 of the vent structure 100 as the elongate members 210 and 220 move between different shapes or positions (i.e., rest position P2 and compressed position P3). Additionally, end connector 230 includes a tab 232 that extends away from end 102 and end connector 240 includes a tab 242 that extends away from end 104. Tabs 232 and 242 may urge the ends 102 and 104 of the vent 100 to remain substantially fixed and prevent portions of the article of apparel 10 adjacent ends 102 and 104 from moving or bending inwards, towards each other.

Figure 6:
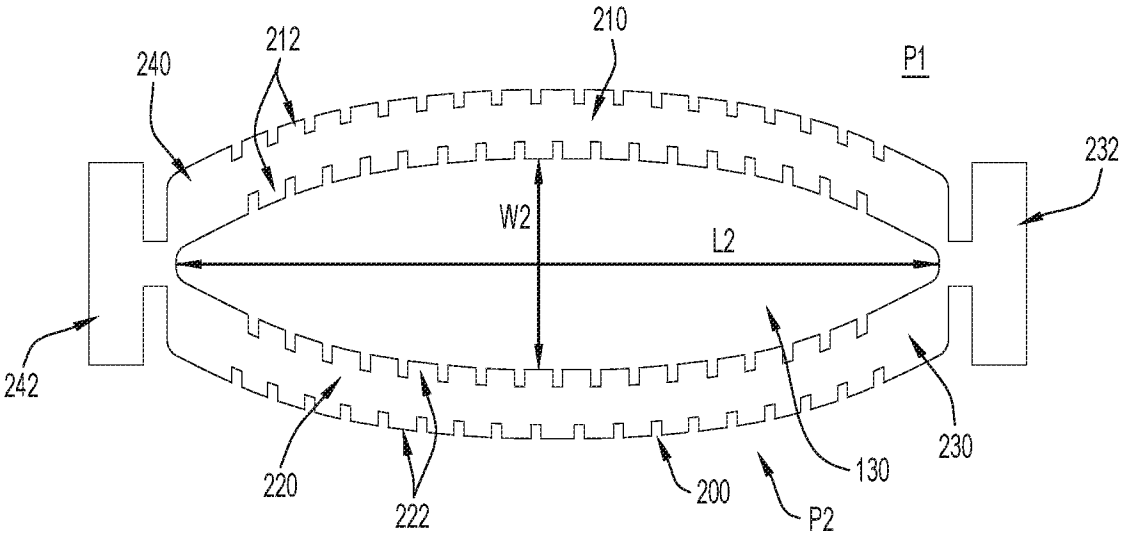
FIG. 6 depicts a top view of a vent structure for forming a vent according to a second example embodiment of the present invention.
Figure 11A:
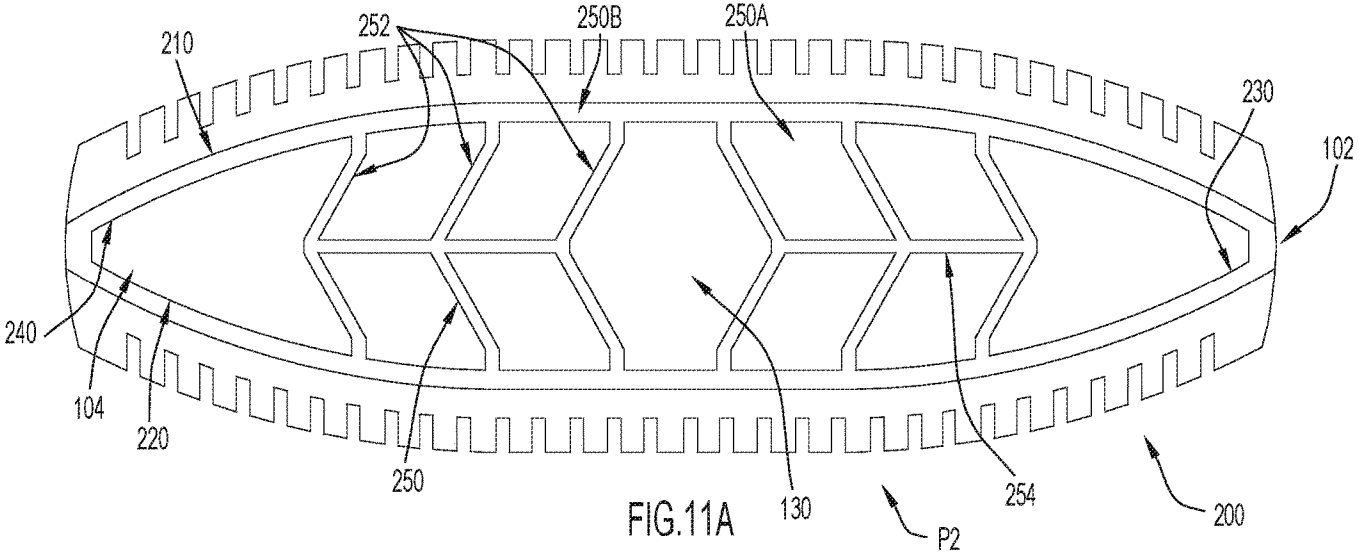
FIG. 11A depicts a top view of a vent structure for forming a vent according to a fifth example embodiment of the present invention.
Figure 11B:
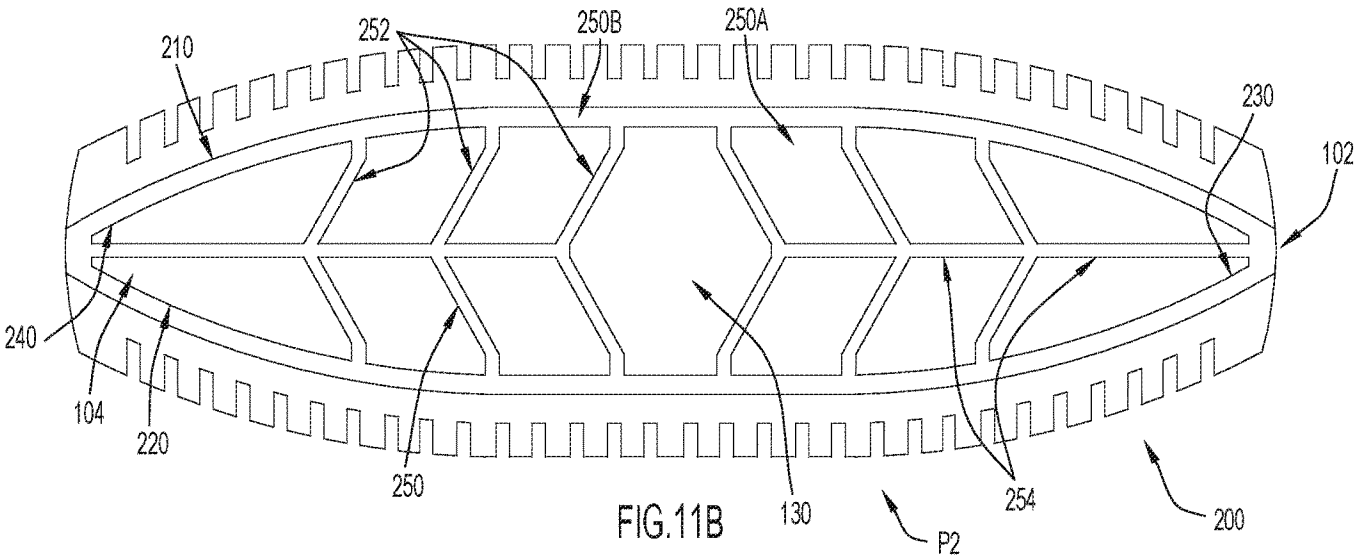
FIG. 11B depicts a top view of a vent structure for forming a vent according to a sixth example embodiment of the present invention.

Put another way, collectively, the notched outer edges 212 and 222 and tabs 232 and 242 may allow the fabric surrounding the vent 100 to move without puckering. However, in other embodiments, one of these features (i.e., only notched outer edges 212 and 222) and/or variations of these features may be utilized to allow the vent structure 200 to bias the vent 100 to an open configuration C2 without causing the fabric of the article of apparel 10 surrounding the vent 100 to pucker. As an example variation, FIG. 6 depicts an embodiment with interior and exterior notches 212 and 222 included along the length of elongate members 210 and 220. As another example, FIGS. 11A and 11B depict embodiments without tabs 232 and 242. As is discussed below, interior ribs 250 may enhance the stability of the vent structure 200 (as compared to a vent structure 200 without ribs 250) and, thus, notched outer edges 212 and 222 may be sufficient to prevent puckering. Regardless of how these anti-puckering features are implemented, anti-puckering features may be important for aesthetics as well as comfort, since puckering might bother a wearer during athletic activity.

Figure 5:
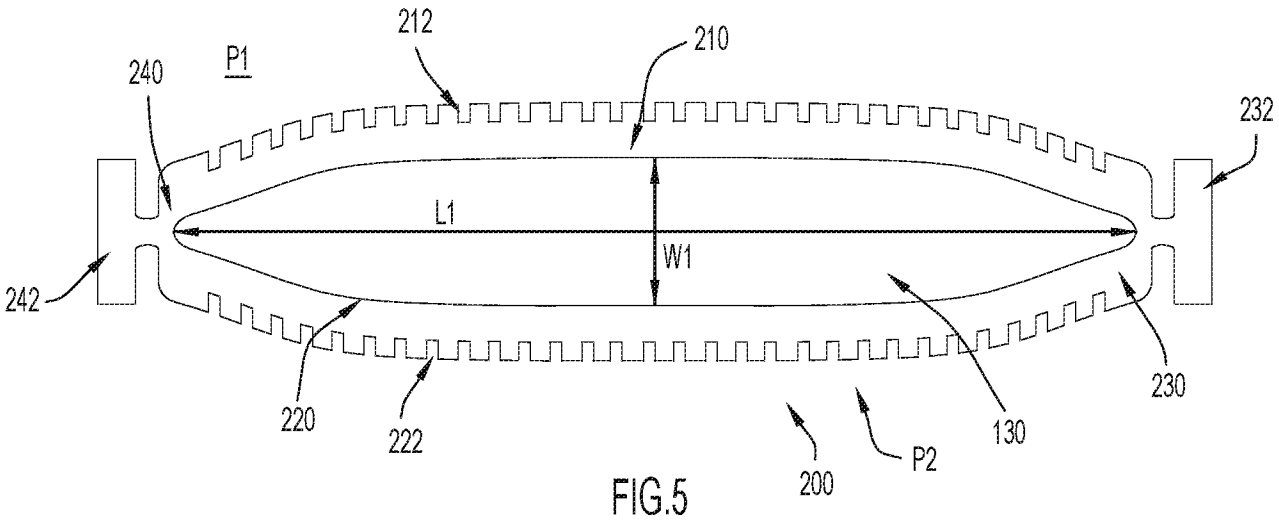
FIG. 5 depicts a top view of the vent structure of FIGS. 1-4.

In FIG. 5, the vent structure 200 included in the embodiment depicted in FIGS. 1-4 is shown removed from the article of apparel 10. For comparison, a second embodiment of a vent structure 200 is depicted in FIG. 6. As is apparent from this comparison, the vent structure 200 may be configured to provide openings 130 of different shapes and sizes when in its rest position P2. However, the two embodiments depicted in FIGS. 5 and 6 are merely two examples and in other embodiments, the vent structure 200 may provide a widened opening of any size or shape (widened as compared to conventional vents that do not include a vent structure 200).

That being said, in the embodiment depicted in FIG. 5, the vent structure 200 is designed to provide a widened opening 130 with a width of W1 and a length of L1 (as measured within a plane P1 intended to simulate the plane of a garment 10). By comparison, in FIG. 6, the vent structure 200 is designed to provide a widened opening 130 with a width of W2 and a length of L2 (also as measured within plane P1). Although the drawings are not to scaled, length L1 is longer than length L2 while width W1 is shorted than W2. However, the dimensions of L1, L2, W1, and W2 may be configured to provide openings of approximately the same total area. Regardless, the elongate members 210 and 220 included in these two embodiments are biased to move a vent to an open configuration C2 in which the sides 110 and 112 are laterally separated from each other within the plane P1 of the garment 10 because the elongate members 210 and 220 included in these two embodiments have a natural or rest position P2 that provides separation therebetween.

Now turning to FIGS. 7-10, 11A, and 11B, in at least some embodiments of the present invention, the vent structure may also include internal ribs 250 configured to supplement (or provide/replace) the natural resiliency of elongate members 210 and 220. Generally, the ribs 250 are configured to resiliently compress as the vent 100 is closed (i.e., as zipper 120 is moved in direction D2) so that the ribs 250 impart an outward, lateral force on sides 110 and 112 (as well as elongate members 210 and 220) as and/or when the vent 100 is closed (i.e., as the vent 100 is moved to a closed configuration C1 and/or when the vent 100 is in the closed configuration C1). The ribs 250 may create outward lateral forces (i.e., in directions D3 and D4) due a natural resiliency of the material used to manufacture the ribs 250 and/or the shape of the ribs 250. As will be explained in further detail below, the ribs 250 may include any number of transverse members 252 (or sets of transverse members 252) and any number of support members 254 extending between the transverse members 252, provided that the ribs 250 can be compressed when the vent structure is in its compressed position P3 and supply a biasing force to urge the vent structure 200 back towards its rest or biased position P2 when the vent structure 200 is moved out of the rest or biased position P2. This allows the vent 100 to close (i.e., to move to a closed configuration C1) while also ensuring the vent 100 provides an expanded or widened opening 130 when the sides 110 and 112 are decoupled from each other.

More specifically, the general shape and size of the transverse members 252 included in the ribs 250 allows the transverse members 252 to move towards the support members 254, compressing the ribs 250, so that the ribs 250 move to a closed configuration C3 as the vent structure 200 moves to its compressed position P3 (see FIG. 10) when the vent 100 is being closed (moved to its closed configuration C1). Moreover, the natural shape and resiliency of the transverse members 252 causes the ribs 250 to exert outward lateral forces (i.e., in directions D3 and D4) on the article of apparel 10 when the vent structure 200 is moved away from its rest position P2. By comparison, when the vent 100 is open (i.e., in the open configuration C2) and the vent structure 200 is in its biased or rest position P2, the ribs 250 may be disposed in an open configuration C4 in which the traverse members 252 extend across the opening 130. When the ribs 250 are in in their open configuration C4, the traverse members 252 ensure that the opening 130 remains open, and its width remains expanded, along a length of the vent 100.

In at least some instances, the ribs 250 may also protect or shield interior fabric layers of the article of apparel from getting caught in the fastener or sealing element that secures side 110 to side 112. For example, in FIG. 9, mesh 260 may extend behind at least a portion of opening 130 and the ribs 250 may discourage or prevent the mesh 260 from getting caught in the zipper 120. As is shown in FIGS. 7-10, 11A, and 11B, the aforementioned characteristics may be achieved or provided with various embodiments of ribs 250. Each of the embodiments is described in turn below.

Figure 7:
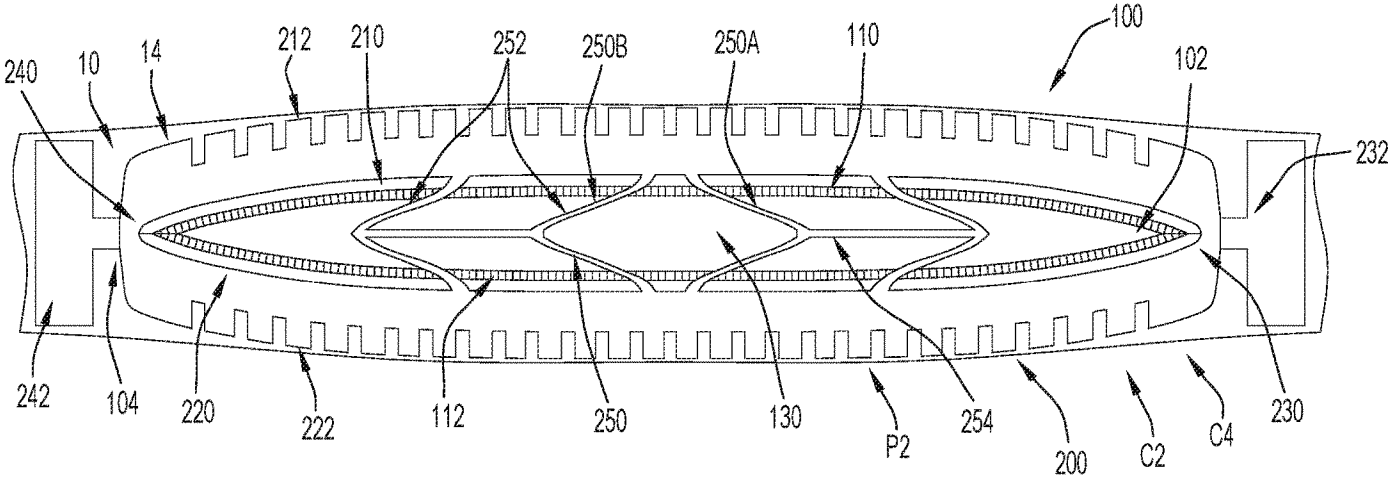
FIGS. 7 and 8 depict interior and exterior views, respectively, of a portion of an article of apparel including a vent formed with a vent structure according to a third example embodiment of the present invention, the vent being open in FIGS. 7 and 8.
Figure 8:
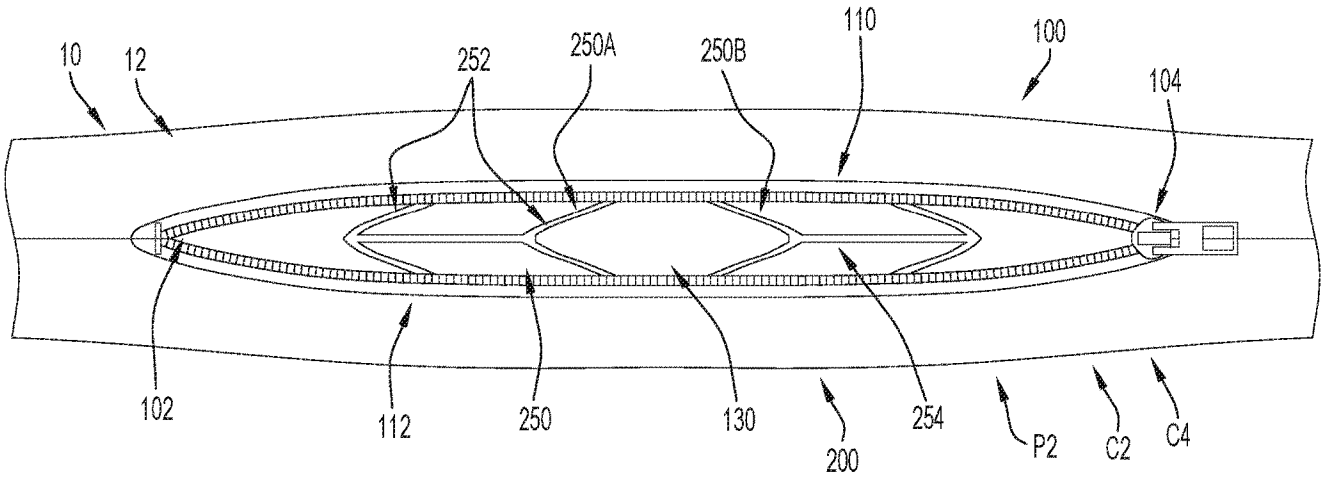

Initially, in FIGS. 7 and 8, the vent structure 200 includes ribs 250 with a first portion 250A and a second portion 250B. Each portion 250A and 250B includes two transverse members 252 that are coupled together with a longitudinal support member 254. More specifically, each transverse member 252 is shaped as an arcuate or rounded V (or like an arrow head), with the bottom of the V pointing outwards towards the nearest end 102 or 104. That is, any transverse members 252 in portion 250A, which is disposed closer to end 102, point towards end 102 and any transverse members 252 in portion 250B, which is disposed closer to end 104, point towards end 104. The longitudinal support members 254 extend between the apexes (or the valleys, depending on the perspective) of the V-shaped transverse members 252 in each section 250A and 250B and provide support/stability. The support members 254 may also serve to guide the transverse members 252 during compression (i.e., during movement of the ribs 250 between their closed configuration C3 and their open configuration C4). That is, the support member 254 may ensure that each of the transverse members 252 fold for compression at or substantially close to its middle or midpoint (i.e., about its apex and/or valley, depending on perspective).

Figure 9:
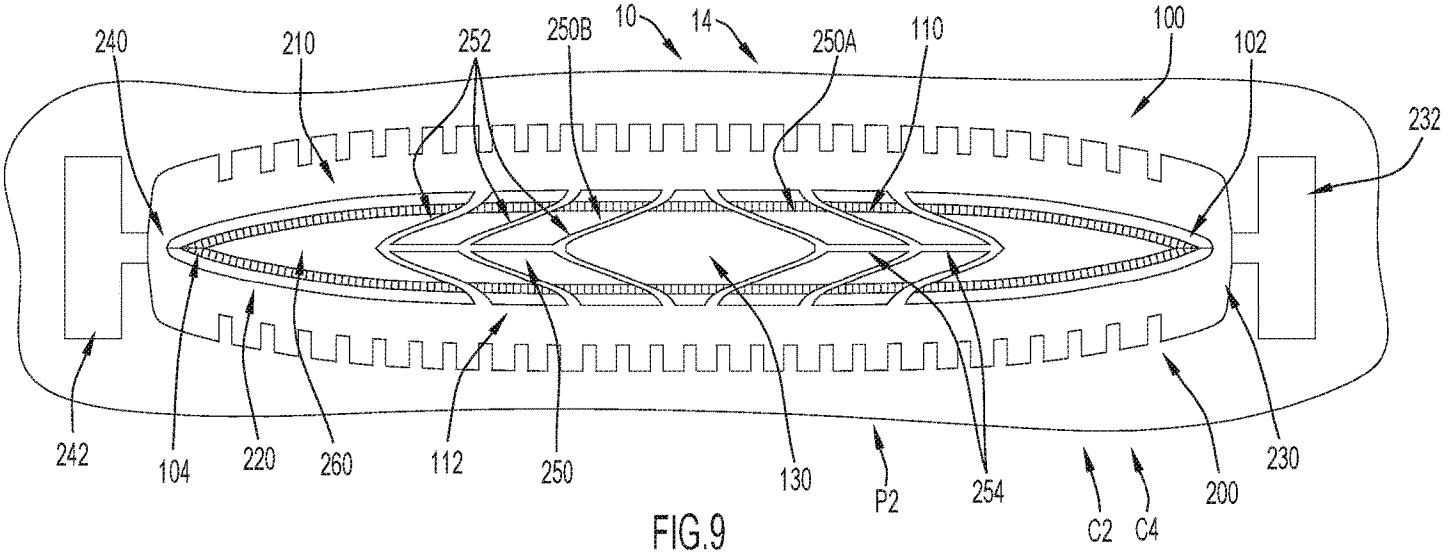
FIGS. 9 and 10 depict interior views of a portion of an article of apparel including a vent formed with a vent structure according to a fourth example embodiment of the present invention, the vent being open in FIG. 9 and closed in FIG. 10.
Figure 10:
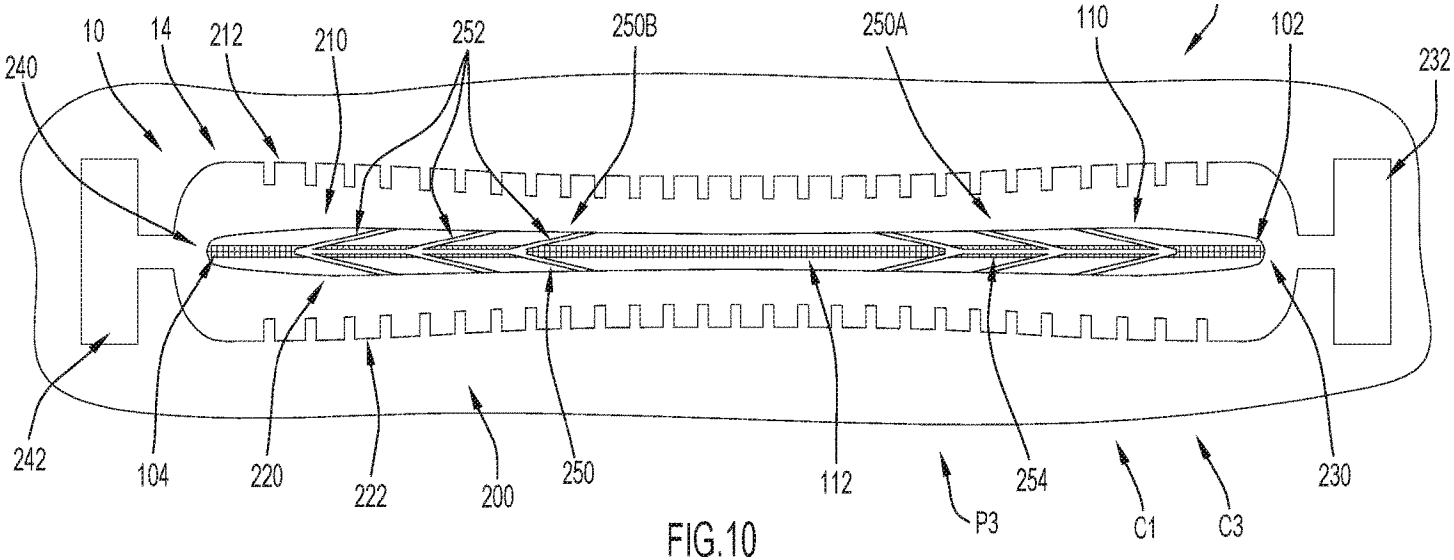

Next, in the implementation shown in FIGS. 9 and 10, the ribs 250 also include a first portion 250A and a second portion 250B. However, each portion 250A and 250B includes three transverse members 252 that are coupled together with a longitudinal support member 254. Again, each transverse member 252 is shaped as an arcuate or rounded V (or like an arrow head), with the bottom of the V pointing outwards towards the nearest end 102 or 104 while the longitudinal support members 254 extend between the apexes (or the valleys, depending on the perspective) of the V-shaped transverse members 252 to provides support/stability and ensure proper folding.

The implementations depicted in FIGS. 11A and 11B are similar to the implementations shown FIGS. 8-10; however, the implementations depicted in FIGS. 11A and 11B include ribs that are substantially straight (as opposed to arcuate) and define more precise (i.e., less rounded) joints. That being said, the vent structure 200 depicted in FIG. 11A is similar to the vent structure 200 depicted in FIGS. 7 and 8 in that it includes ribs 250 with a first portion 250A and a second portion 250B that each include two outward-pointing transverse members 252 that are coupled together with a longitudinal support member 254. Likewise, the vent structure 200 depicted in FIG. 11B is similar to the vent structure 200 depicted in FIGS. 9 and 10 in that it includes ribs 250 with a first portion 250A and a second portion 250B that each include three outward-pointing transverse members 252 that are coupled together with a longitudinal support member 254.

One notable difference between the vent structure 200 depicted in FIG. 11B and the other embodiments depicted in FIGS. 7-10 and 11A is that the support member 254 included in the first portion 250A of the vent structure 200 of FIG. 11B extends to the end connector 230 and the support member 254 included in the second portion 250B of the vent structure 200 of FIG. 11B extends to the end connector 240. This may provide additional support for the outward biasing (i.e., in directions D3 and D4) and/or help to prevent puckering in fabric of the article of apparel 10 that is proximate to the vent 100, as discussed above. Another notable difference is that the vent structures 200 depicted in FIGS. 11A and 11B do not include tabs extending from end connectors 230 and 240 (i.e., tabs 232 and 242). As mentioned above, in at least some embodiments, the tabs 232 and 242 may not be necessary to prevent puckering. This may be particularly true when the vent structure includes ribs 250 that add stability to the vent structure 200 as the vent structure moves between its rest position P2 and its compressed position P3.

Figure 12:
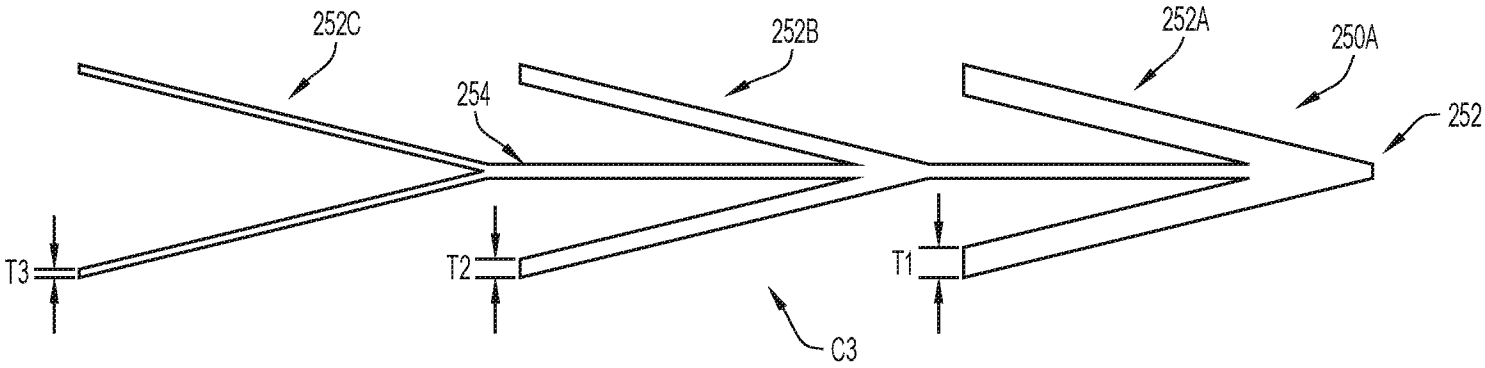
FIG. 12 depicts a top view of a portion of a vent structure according to an example embodiment of the present invention.
Figure 13:
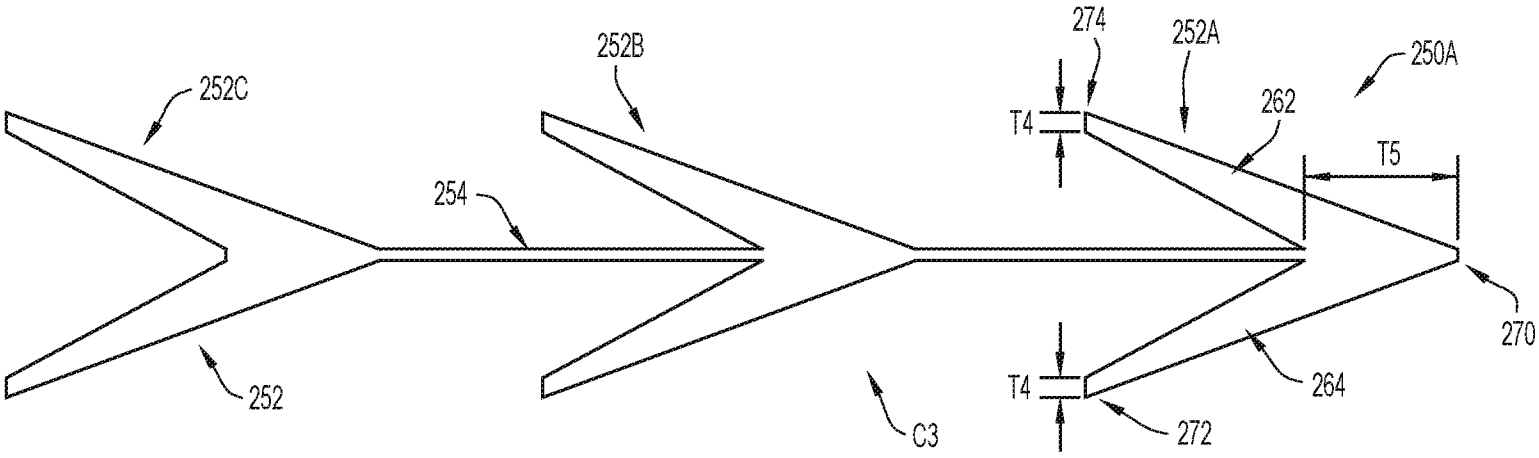
FIG. 13 depicts a top view of a portion of a vent structure according to another example embodiment of the present invention.

Now turning to FIGS. 12 and 13, for a description of two example vent portions 250B configured in accordance with two additional embodiments. The two embodiments depicted in FIGS. 12 and 13 depict example rib structures with modified transverse members 252. These transverse members 252 may be utilized instead of or in addition to modifying the number of transverse member 252 included in ribs 250 and/or modifying the overall shape of the vent structure 200. That is, in addition to or as an alternative to altering the number of transverse members 252 included in a vent structure 200, the transverse members 252 themselves may be adjusted to ensure the vent structure 200 provides a suitable opening 130. Two example embodiments of modified transverse members 252 are depicted in FIGS. 12 and 13. In FIG. 12, the transverse members 252 each have a different thickness (as represented by thicknesses T1, T2, and T3). Meanwhile, in FIG. 13, the transverse members 252 all vary in thickness along the length of the transverse members 252. However, these two embodiments are merely examples and in other embodiments, any combinations or variations of thickness may be utilized to provide suitable transverse members (i.e., transverse members 252 that can compress to their closed configuration C3 as the vent structure 200 to its compressed position P3 while also exerting outward lateral forces (i.e., in directions D3 and D4) when the vent structure 200 is moved away from its rest position P2).

More specifically, in FIG. 12, rib portion 250A includes three transverse members 252 that are labeled as transverse member 252A, 252B, and 252C, but to be understood to be representative of any transverse member 252. Transverse members 252A, 252B, and 252C are each V-shaped, pointing in the same outward direction (i.e., towards end 102, which might be adjacent transverse member 252A). However, moving from inside to outside (left to right on the drawing sheet, when viewed in landscape), transverse members 252A, 252B, and 252C increase in thickness. That is, transverse member 252C has a thickness T3, transverse member 252B has a thickness T2, transverse member 252A has a thickness T1, and T3 is smaller than T2, which is smaller than T1. Providing this arrangement of increasing thickness may be beneficial because the amount of tension created by the elongate members 210, 220, end connectors 230, 240, and/or the zipper 120 (or other such fastener/closure element) may increase closer to the ends 102 and 104 of the vent 100. Since thicker transverse members 252 may create stronger laterally outward forces (i.e., the bias in directions D3 and D4 may be stronger), transverse members 252 that increase in thickness as they approach the ends 102, 104 may counteract the increased tension at the ends 102 and 104 and ensure that the vent 100 provides an opening of desirable width along its entire length (and does not close adjacent or proximate its ends 102, 104).

In FIG. 13, each of transverse member 252A, 252B, and 252C has an identical shape (i.e., transverse member 252A, 252B, and 252C all have the same thickness measurements), but each transverse member 252A, 252B, and 252C varies in thickness along its height (i.e., the thickness may vary across the opening 130). In particular, each transverse member 252 includes a top portion 262 that extends from a top 274 to a midpoint or apex 270 and a bottom portion 264 that extends from a bottom 272 to the midpoint or apex 270. At or proximate to the top 274 and the bottom 272, the transverse member has a thickness T4, but the thickness of the top portion 262 and the bottom portion 264 increases towards the midpoint 270, to a thickness T5. This increasing thickness may increase the resiliency of the transverse member (i.e., increase the lateral outward forces in direction D3 and D4 created by compressing the ribs 250) because it may require more force to overcome the thick center portion of the transverse member 252.

As mentioned, the embodiments shown in FIGS. 12 and 13 are merely examples and in other embodiments, any combinations or variations may be utilized. For example, some transverse members 252 included in a set of ribs 250 may have a varying thickness (as shown in FIG. 13) while other transverse members 252 in the set of ribs 250 have a consistent thickness (as shown in FIG. 12). As another example, the transverse members 252 in a set of ribs 250 may each include thickness variations of the same proportions, but the maximum thickness (i.e., the midpoint thickness T5) of each transverse member, may increase approaching the outer edge of the vent 100 (i.e., a combination of FIGS. 12 and 13). As yet another example, a set of ribs 250 might include a first portion 250A with constant thickness and a second portion 250B with varied thickness. Still further, the thickness of the transverse members 252 may remain the same throughout the ribs 250, but the durometer of the transverse member 252 or the material of the transverse member 252 may be altered to provide similar characteristics to the thickness variations shown in FIGS. 12 and 13.

Figure 14:
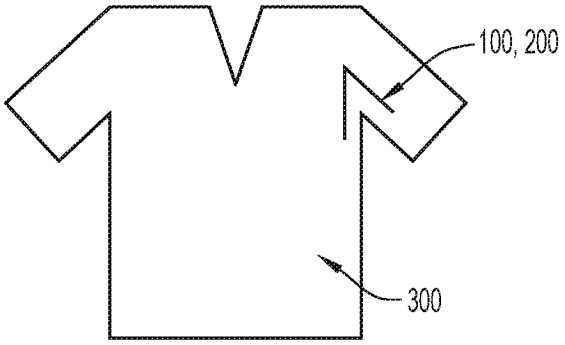
FIGS. 14-16 depict articles of apparel including one or more vents formed with a vent structure according to an embodiment of the present invention.
Figure 15:
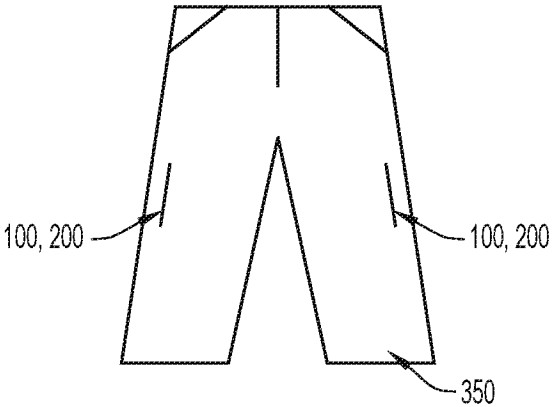
Figure 16:
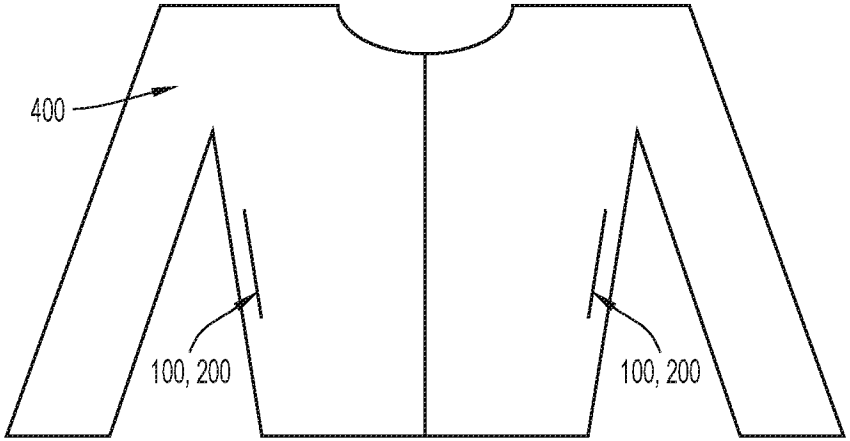

Now turning to FIGS. 14-16, the vent 100 presented herein may be included in any article of apparel. FIGS. 14-16 provide three example articles or apparel. As is explained below in connection with FIG. 17, the vent 100 may be provided by installed or including a vent structure 200 on an interior side or layer of an article of apparel, around an opening, slit, or slot included in or formed in the article of apparel. For simplicity, FIGS. 14-16 are described as including a vent 100, but it is to be understood that the vent 100 could be formed in an article of apparel during production/manufacturing or installed therein subsequent to manufacturing/production (i.e., retrofitted). In FIG. 14, the vent 100 is included along the armpit of a shirt 300. In order to extend along the torso and arm of the armpit, the vent 100 may include a bend therein or be formed from two vent structures 200. Regardless, the vent 100 is configured to open laterally, in the planes of the shirt on which it is included. That is, the portion of the vent 100 included on the torso of the shirt 300 opens around the torso while the portion of the vent 100 included on the arm opens around the arm, within natural planes or positions of the shirt 300.

In FIG. 15, a pair of vents is included on a pair of pants 350, such as ski pants. Meanwhile, in FIG. 16, a pair of vents 100 is included on a jacket, such as a ski coat or rain coat. Again, the vent 100 is configured to open laterally, in the same plane as the portion of the pants or jacket on which it is included. That is, the vents 100 included on the pants 350 opens around the wearer's leg while the vents 100 included on the jacket 400 open laterally around the wearer's torso. The vents do not open towards or away from the wearer, regardless of whether the vents 100 are included on a shirt 300, pants 350, a jacket 400, or any other article of apparel.

Referring generally to FIGS. 7-10, 11A, 11B, and 12-16, if a vent structure 200 includes longer/additional support members 254 (i.e., like the vent structure shown in FIG. 11B) additional transverse members 252 (i.e., six as compared to four, as included in FIGS. 9, 10, and 11B), and/or more resilient transverse members 252 (i.e., transverse members 252 with thickness T1 as opposed to thickness T3), the vent structure 200 may be more suitable for articles of apparel formed from heavier fabrics (i.e., an insulated garment). By comparison, if the number of transverse members 252 included in a vent structure 200 is minimized (i.e., limited to only four transverse members 252, as included in FIGS. 7, 8, and 11A, or even to only two transverse members 252) and/or the resiliency of the transverse members 252 is minimized (i.e., the transverse members have a thickness T3 instead of T2 or T1), the vent structure 200 may be lighter and, thus, may be more suitable for articles of apparel formed from lightweight fabrics (i.e., running or golf garments).

As a specific example, the vent structure depicted in FIG. 11B may be slightly heavier than the vent structure depicted in FIG. 11A, but may provide a stronger opening force (i.e., stronger lateral forces in directions D3 and D4) as compared to the vent structure depicted in FIG. 11A. Consequently, the vent structure 200 depicted in FIG. 11B may be more suitable for heavier fabric (i.e., may be configured to provide an opening 130 in heavier fabric of sufficient size to quickly dissipate heat). By comparison, the vent structure 200 depicted in FIG. 11A may be more that capable of providing an opening 130 of sufficient size in lighter fabrics and may do so without adding unnecessary weight to the article of apparel 10.

This balancing of weight against opening force may be used to select or design the appropriate vent structure (or rib structure) for a particular garment. However, any vent structure 200 presented herein (including any rib structure or no rib structure) may be suitable to expose an opening 130 that is expanded as compared to conventional vent openings (i.e., simple zipper vents) in at least some fabrics utilized for articles of apparel. The expanded opening 130, which is primarily expanded laterally, with respect to the width of the opening (as indicated, for example, in FIGS. 5 and 6 by widths W1 and W2) allows for quick and efficient ventilation. Consequently, smaller vents 100 (with respect to length) can be included on articles of apparel 10 and/or the vents 100 included on an article of apparel can be opened for shorter amounts of times. For example, a 6-inch vent 100 formed with a vent structure 200 described herein (i.e., a vent having a length of 6 inches) might provide the same amount of ventilation (i.e., heat dump) as a standard 18-inch zipper vent.

Figure 17:
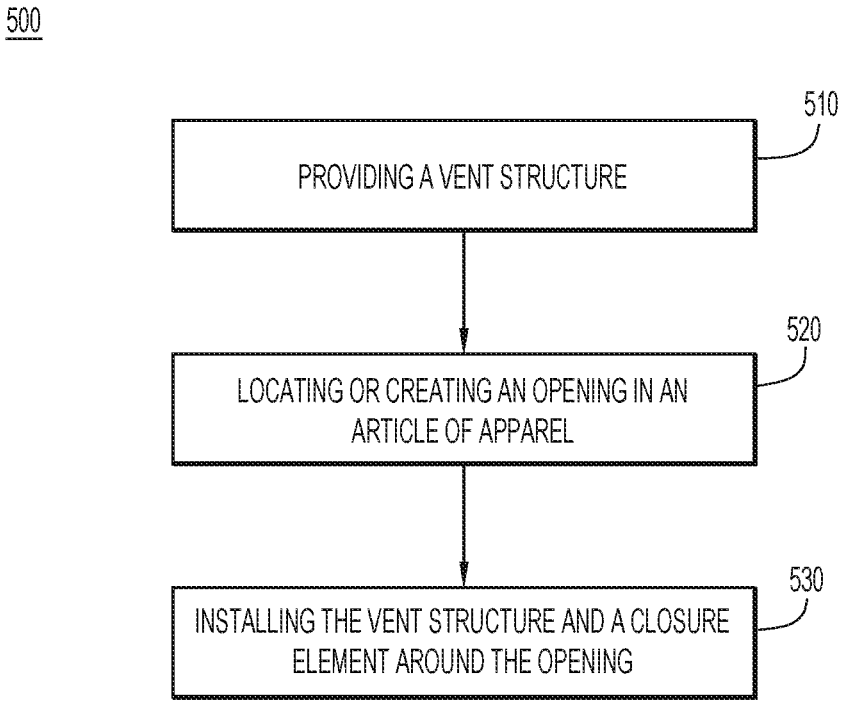
FIG. 17 depicts a method of forming a vent in an article of apparel, according to an embodiment of the present invention.

Now turning to FIG. 17 for a description of a high-level method 500 of forming a vent 100 on an article of apparel. Initially, a vent structure 200 is provided at 510. As mentioned, the vent structure may be provided via three dimensional printing, injection molding, or any other process now known or hereafter developed for manufacturing structures from resilient material (i.e., plastics). At 520, an opening is located or created in article of apparel. If the article of apparel is being created with the vent 100 included therein, an opening may be left in at least one layer of material. This opening may then be utilized as the opening 130 for the vent 100. If, on the other hand, the vent 100 is installed onto a fully formed (i.e. preexisting) article of apparel, an opening may be formed (i.e., cut) in the article of apparel. At 530, the vent structure and a closure element are installed (i.e., sewn, glued, or otherwise attached) on the article of apparel around the opening. The vent structure is installed on an interior side of the opening (as shown throughout the Figures) and the closure element is installed on an exterior side of the opening. As has been explained herein, the vent structure will bias the opening to an open configuration while still allowing the closure element to selectively close the opening.

It is therefore intended that the present invention covers the modifications and variations of this invention provided they come within the scope of the appended claims and their equivalents. It is to be understood that terms such as "top," "bottom," "front," "rear," "side," "height," "length," "width," "upper," "lower," "interior," "exterior," "medial," "lateral," and the like as may be used herein, merely describe points of reference and do not limit the present invention to any particular orientation or configuration. Moreover, while the invention has been described in detail and with reference to specific embodiments thereof, it will be apparent to one skilled in the art that various changes and modifications can be made therein without departing from the spirit and scope thereof

What is claimed:

1. A vent structure comprising:
   - a first elongate member configured to be attached to a first side of an opening formed in an article of apparel;
   - a second elongate member configured to be attached to a second side of the opening, the second side being opposite the first side; and
   - a set of ribs extending between the first elongate member and the second elongate member, wherein the set of ribs includes one or more outwardly pointing transverse members, each of which is connected to and extends between the first elongate member and the second elongate member and each of which is configured to:
     - compress when the first side and the second side are secured together; and
     - exert a laterally outward force on the first elongate member and the second elongate member so that the first elongate member, the second elongate member, and the set of ribs bias the first side and the second side to an open configuration that exposes and expands the opening.

2. The vent structure of claim 1, wherein the set of ribs include a first portion adjacent a first end of the opening and a second portion adjacent a second end of the opening, and wherein the outwardly pointing V-shaped transverse members in the first portion point towards the first end and the outwardly pointing V-shaped transverse members in the second portion point towards the second end.

3. The vent structure of claim 2, wherein the first portion and the second portion each include two or more of the outwardly pointing V-shaped transverse members.

4. The vent structure of claim 2, wherein the outwardly pointing V-shaped transverse members in the first portion are coupled together by a first support member and the outwardly pointing V-shaped transverse members in the second portion are coupled together by a second support member.

5. The vent structure of claim 1, wherein the one or more outwardly pointing V-shaped transverse members comprise:
   - a plurality of V-shaped transverse members with varied thicknesses.

6. The vent structure of claim 1, wherein at least one of the one or more outwardly pointing V-shaped transverse members varies in thickness across the opening.

7. The vent structure of claim 1, wherein a V-shape of the one or more outwardly pointing V-shaped transverse members is an arcuate V-shape.

8. The vent structure of claim 1, wherein the one or more outwardly pointing V-shaped transverse members compress by folding at an apex of a V-shape.

9. The vent structure of claim 1, wherein the first side and the second side move to the open configuration by moving laterally away from each other.

10. The vent structure of claim 9, wherein the first side and the second side move to the open configuration without moving towards or away from a wearer wearing the article of apparel.

11. The vent structure of claim 1, further comprising:

anti-puckering features that allow fabric of the article of apparel to move with minimal puckering as the vent structure moves between the open configuration and a closed configuration.

12. An article of apparel with a vent, comprising:

a vent opening formed between two edges of one or more layers of material forming the article of apparel; and a vent structure that biases the two edges to move laterally away from each other within a resting plane of the article of apparel, the vent structure including resilient ribs that extend between and connect to two elongate members disposed on the two edges, wherein the resilient ribs are outwardly pointing V-shaped ribs, and wherein the resilient ribs and the two elongate members urge the two edges to remain laterally separated from each other during movement of the article of apparel.

13. The article of apparel with a vent of claim 12, wherein the resting plane is parallel to a wearer's body.

14. The article of apparel with a vent of claim 12, further comprising:

a closure element that can overcome the urging from the resilient ribs and selectively secure the two edges together to selectively close the opening; and an interior layer disposed beneath the opening, wherein the resilient ribs are disposed between the closure element to shield the interior layer from the closure element.

15. The article of apparel with a vent of claim 12, wherein the article of apparel is a jacket, a shirt, or a pair of pants, and wherein the vent opens laterally around a wearer's torso when the article of apparel comprises the jacket or the shirt, and the vent opens laterally around a wearer's leg when the article of apparel is the pair of pants.

16. A method of forming an expanded vent on an article of apparel, comprising:

providing a vent structure that includes a set of ribs that extend between and connect to a first elongate member and a second elongate member, wherein the set of ribs includes outwardly pointing V-shaped transverse members, and the set of ribs bias the first elongate member and the second elongate member to an open configuration in which the first elongate member is laterally separated from the second elongate member;

locating or creating a vent opening in an article of apparel; and installing the vent structure around the vent opening so that the vent structure exposes and expands the vent opening.

17. The method of claim 16, wherein the vent structure is installed on an interior surface of the article of apparel and the method further comprises:

installing a closure element on an exterior surface of the article of apparel, the closure element being configured to removable secure a portion of the article of apparel disposed on a first side of the opening to a portion of the article of apparel disposed on a second side of the opening.

18. The method of claim 16, wherein the providing comprises:

providing a first vent structure for the article of apparel formed from a first fabric; and providing a second vent structure for a second article of apparel formed from a second fabric, wherein the first fabric is heavier than the second fabric and the first vent structure creates a larger biasing force than the second vent structure.

19. A vent structure comprising:

a first elongate member configured to be attached to a first side of an opening formed in an article of apparel;

a second elongate member configured to be attached to a second side of the opening, the second side being opposite the first side; and a set of ribs extending between and connect to the first elongate member and the second elongate member, wherein the set of ribs includes one or more outwardly pointing V-shaped transverse members; the first elongate member, the second elongate member, and the set of ribs bias the first side and the second side to an open configuration that exposes and expands the opening; and the first side and the second side move to the open configuration by moving laterally away from each other.

20. The vent structure of claim 19, wherein the first side and the second side move to the open configuration without moving towards or away from a wearer wearing the article of apparel.

21. A vent structure comprising:

a first elongate member configured to be attached to a first side of an opening formed in an article of apparel;

a second elongate member configured to be attached to a second side of the opening, the second side being opposite the first side;

a set of ribs extending between and connect to the first elongate member and the second elongate member, wherein the set of ribs includes one or more outwardly pointing V-shaped transverse members, and wherein the first elongate member, the second elongate member, and the set of ribs bias the first side and the second side to an open configuration that exposes and expands the opening; and anti-puckering features that allow fabric of the article of apparel to move with minimal puckering as the vent structure moves between the open configuration and a closed configuration.

22. The vent structure of claim 21, wherein the first side and the second side move to the open configuration by moving laterally away from each other.

23. The vent structure of claim 22, wherein the first side and the second side move to the open configuration without moving towards or away from a wearer wearing the article of apparel.

* * * * *